US009935410B2

(12) United States Patent
Roberts

(10) Patent No.: US 9,935,410 B2
(45) Date of Patent: Apr. 3, 2018

(54) ELECTRICAL CONNECTOR HAVING MALE AND FEMALE CONNECTORS

(71) Applicant: Sterling Innovation Inc., Prince George (CA)

(72) Inventor: Sterling Roberts, Prince George (CA)

(73) Assignee: STERLING INNOVATION INC., Prince George, British Columbia (CA)

( * ) Notice: Subject to any disclaimer, the term of this patent is extended or adjusted under 35 U.S.C. 154(b) by 0 days.

(21) Appl. No.: 15/249,111

(22) Filed: Aug. 26, 2016

(65) Prior Publication Data

US 2018/0062330 A1 Mar. 1, 2018

(51) Int. Cl.

| | |
|---|---|
| ***H01R 13/11*** | (2006.01) |
| ***H01R 24/86*** | (2011.01) |
| ***H01R 24/38*** | (2011.01) |
| ***H01R 13/05*** | (2006.01) |
| *H01R 103/00* | (2006.01) |

(52) U.S. Cl.

CPC ..... *H01R 24/38* (2013.01); *H01R 13/052* (2013.01); *H01R 13/111* (2013.01); *H01R 24/86* (2013.01); *H01R 2103/00* (2013.01)

(58) Field of Classification Search

CPC ..... H01R 24/76; H01R 24/78; H01R 24/86; H01R 13/111; H01R 24/66; H01R 24/38; H01R 24/54; H01R 24/70; H01R 13/052; H01R 2103/00; H01R 24/68

USPC ..... 439/92

See application file for complete search history.

(56) References Cited

U.S. PATENT DOCUMENTS

| | | | |
|---|---|---|---|
| 2,158,385 | A | 5/1939 | Schwein |
| 2,448,509 | A | 5/1948 | Antony, Jr. et al. |
| 2,775,745 | A | 12/1956 | Eaton |
| 2,843,715 | A | 7/1958 | Paley |
| 2,877,437 | A | 3/1959 | Flanagan, Jr. |
| 2,933,711 | A | 4/1960 | Eaton |
| 3,088,089 | A | 4/1963 | Gregoire |

(Continued)

FOREIGN PATENT DOCUMENTS

| | | |
|---|---|---|
| CN | 101727113 B | 7/2013 |
| EP | 0039656 A1 | 11/1981 |

(Continued)

OTHER PUBLICATIONS

Google Patents: machine translation of the Chinese reference No. CN1017271138.

*Primary Examiner* — Renee Luebke
*Assistant Examiner* — Paul Baillargeon
(74) *Attorney, Agent, or Firm* — Nicholas Aitken; Bereskin & Parr LLP/S.E.N.C.R.L., s.r.l.

(57) ABSTRACT

An electrical connector includes a female connector removably connectable with a male connector. The female connector includes an outer ring shield, and first and second ring insulator. The first ring insulator is spaced inwardly of the outer ring shield to define a first recess with a first female electrical contact provided in the first recess. The second ring insulator is spaced inwardly of the first ring insulator to define a second recess with a second female electrical contact provided in the second recess. The male connector includes first and second. When the male and female connectors are electrically connected, the first and second male electrical contacts are received in the first and second recesses respectively.

17 Claims, 13 Drawing Sheets

(56) References Cited

U.S. PATENT DOCUMENTS

| | | | |
|---|---|---|---|
| 3,109,690 | A | 11/1963 | Stevens, Jr. |
| 3,136,842 | A | 6/1964 | Braun et al. |
| 3,193,309 | A | 7/1965 | Morris |
| 3,336,563 | A | 8/1967 | Hyslop |
| 3,363,214 | A | 1/1968 | Wright |
| 3,786,391 | A | 1/1974 | Mathauser |
| 3,808,577 | A | 4/1974 | Mathauser |
| 3,810,258 | A | 5/1974 | Mathauser |
| 3,926,493 | A | 12/1975 | Wakabayashi |
| 3,953,099 | A | 4/1976 | Wilson |
| 4,240,466 | A | 12/1980 | Herzan et al. |
| 4,261,632 | A | 4/1981 | Narozny |
| 4,609,247 | A | 9/1986 | Annoot |
| 4,815,986 | A | 3/1989 | Dholoo |
| 4,955,828 | A | 9/1990 | Gruenberg |
| 5,080,600 | A | 1/1992 | Baker et al. |
| 5,217,391 | A | 6/1993 | Fisher, Jr. |
| 5,263,877 | A | 11/1993 | Mitani |
| 5,344,330 | A | 9/1994 | Hoffman |
| 5,346,406 | A | 9/1994 | Hoffman et al. |
| 5,385,480 | A | 1/1995 | Hoffman |
| 5,401,175 | A | 3/1995 | Guimond et al. |
| 5,427,542 | A | 6/1995 | Gerow |
| 5,462,452 | A | 10/1995 | Devine |
| 5,478,250 | A | 12/1995 | Hoffman |
| 5,516,303 | A | 5/1996 | Yohn et al. |
| 5,674,088 | A | 10/1997 | Roche et al. |
| 5,759,069 | A | 6/1998 | Kitatani et al. |
| 5,820,408 | A | 10/1998 | Wang |
| 6,224,407 | B1 | 5/2001 | Duquerroy et al. |
| 6,364,675 | B1 | 4/2002 | Brauer et al. |
| 6,511,341 | B1 | 1/2003 | Finona et al. |
| 6,623,276 | B2 | 9/2003 | Dalmau Ferrerfabrega et al. |
| 6,719,592 | B2 | 4/2004 | Friedow et al. |
| 6,910,911 | B2 | 6/2005 | Mellott et al. |
| 7,001,199 | B1 | 2/2006 | Badalpour |
| 7,052,282 | B2 | 5/2006 | Meleck et al. |
| 7,097,490 | B2 | 8/2006 | Eaton et al. |
| 7,114,966 | B2 | 10/2006 | Cecchi |
| 7,147,518 | B2 | 12/2006 | Marechal et al. |
| 7,164,079 | B2 | 1/2007 | Lahnen et al. |
| 7,192,303 | B2 | 3/2007 | Kohen |
| 7,311,566 | B2 | 12/2007 | Dent |
| 7,354,315 | B2 | 4/2008 | Goetz et al. |
| 7,435,135 | B2 | 10/2008 | Wlos |
| 7,500,882 | B2 | 3/2009 | Goetz et al. |
| 7,510,432 | B2 | 3/2009 | Entsfellner |
| 7,726,973 | B1 | 6/2010 | Perry |
| 7,887,377 | B1 | 2/2011 | Wallace |
| 8,105,091 | B2 | 1/2012 | Nishihira et al. |
| 8,197,260 | B2 * | 6/2012 | Wadsworth ..... H01R 31/065 439/13 |
| 8,262,403 | B2 | 9/2012 | Slippy et al. |
| 8,288,986 | B2 | 10/2012 | Flack |
| 8,439,707 | B2 | 5/2013 | Montena |
| 2005/0082915 | A1 | 4/2005 | Steinberg |
| 2009/0068892 | A1 | 9/2009 | Godovich |
| 2011/0074351 | A1 | 3/2011 | Bianco et al. |
| 2011/0269332 | A1 | 11/2011 | Kim et al. |
| 2012/0306444 | A1 | 12/2012 | Pham et al. |
| 2013/0187601 | A1 | 7/2013 | Petrie et al. |
| 2013/0244486 | A1 | 9/2013 | Ohsaka |

FOREIGN PATENT DOCUMENTS

| | | | |
|---|---|---|---|
| EP | 0334610 | A1 | 3/1994 |
| EP | 0334609 | A1 | 6/1994 |
| EP | 0979544 | B1 | 6/2002 |
| EP | 1220369 | A1 | 7/2002 |
| EP | 1688747 | A1 | 8/2006 |
| EP | 2190078 | A1 | 5/2010 |
| EP | 2639885 | A1 | 9/2013 |
| GB | 2085676 | A3 | 4/1982 |
| GB | 2128038 | A | 4/1984 |
| WO | 1998031078 | A1 | 7/1998 |

* cited by examiner

ELECTRICAL CONNECTOR HAVING MALE AND FEMALE CONNECTORS

FIELD

This disclosure relates to the field of electrical connectors, and more particularly to electrical connectors having a male connector removably electrically connectable with a female connector.

INTRODUCTION

Electrical connectors are devices that provide a disconnectable electrical connection along an electrical pathway. Typically, an electrical connector includes a male connector that is removably connectable to a female connector. When the male and female connectors are connected, the electrical connector defines one or more electrical pathways across the juncture of the male and female connectors.

SUMMARY

In accordance with one aspect of this disclosure, an electrical connector is provided that utilizes a male connector releasably engageable with a female connector wherein each of the male and female connectors utilize a plurality of axially extending contact members that are arranged concentrically. For example, if the connector is for use with a wire that includes a ground, then each of the male and female connectors may be provided with three concentrically arranged contact members (hot, neutral and ground). However, if the connector is for use with a wire that does not include a ground, then each of the male and female connectors may be provided with two concentrically arranged contact members (hot and neutral). The contact members are preferably separated from each other by insulators and accordingly, a plurality of concentrically arranged insulators may be provided. An advantage of arranging the contact members in annular bands is that the male and female connectors may be connected by only axially aligning the male and female connectors. Accordingly, a user need not rotate, e.g., the male connector about is axis so as to align it with the female connector prior to inserting the male connector into the female connector.

Each contact member may be configured as a continuous annular member. Alternately, a contact member may comprise a plurality of discrete members that are arranged in an annular band. Similarly, each insulator may be a continuous annular band or a plurality of discrete members arranged in an annular band.

The outer surface of the outer annular member of the male connector may be an insulator. For example, the outer annular member may be an annular insulator with a conductive member provided on the inner surface thereof. An advantage of this embodiment is that the conductive members may be provided internal of an outer annular insulator so that the likelihood of a user touching a conductive member is reduced. Further, it will be appreciated that the insulators of the male and female connectors may extend axially further outwardly from a main body of the connector than the conductive members. Accordingly, in such an embodiment, the likelihood of a user touching a conductive member may be further reduced.

Alternately, or in addition, it will also be appreciated that the ground contact member may be positioned as the outermost conductive member. In such an embodiment, the likelihood of a user touching the hot or neutral conductive members is reduced.

In any embodiment, the annular members or bands of the male and female connectors may be sized so as to frictionally engage each other to thereby secure the male and female connectors in an engaged position.

In accordance with this aspect, there is provided an electrical connector is provided. The electrical connect may comprise a female connector removably connectable with a male connector. The female connector may include an outer ring shield, a first ring insulator, and a second ring insulator. The first ring insulator may be spaced inwardly of the outer ring shield to define a first recess between the outer ring shield and the first ring insulator with a first female electrical contact provided in the first recess. The second ring insulator may be spaced inwardly of the first ring insulator to define a second recess between the first and second ring insulators with a second female electrical contact provided in the second recess. The male connector may include at least one first male electrical contact and at least one second male electrical contact, and at least one third male electrical contact. When the male and female connectors are electrically connected together, the first male electrical contact is received in the first recess and the second male electrical contact is received in the second recess.

In any embodiment, the second ring insulator may have an inner cavity defining a third recess with a third female electrical contact provided in the third recess and the male connector may include at least one third male electrical contact wherein, when the male and female connectors are electrically connected together, the third male electrical contact is received in the third recess.

In any embodiment, the outer ring shield may comprise an outer ring shield outer surface that is free of electrical contacts.

In any embodiment, the first and second ring recesses may be concentric annular recesses.

In any embodiment, the first ring insulator may have a first ring insulator outer surface, the outer ring shield may have an outer ring shield inner surface, and the first male connector electrical contact may be a sleeve-type contact that at least substantially lines at least one of the first ring insulator outer surface and the outer ring shield inner surface.

In any embodiment, the first ring insulator may have a first ring insulator inner surface, the second ring insulator may have a second ring insulator outer surface, and the second male connector electrical contact may be a sleeve-type contact that at least substantially lines at least one of the first ring insulator inner surface and the first ring insulator outer surface.

In any embodiment, the third male connector electrical contact may be a sleeve-type contact that at least substantially lines the third ring insulator inner surface.

In any embodiment, the third male connector electrical contact may be a pin-type contact.

In any embodiment, the third female connector electrical contact may be a pin-type contact.

In any embodiment, the third male connector electrical contact may be a sleeve-type contact.

In any embodiment, the male connector may further comprise a body having the first, second and third male connector electrical contacts provided at one end and one of a plug or a socket provided at a longitudinally spaced apart second end of the body. In any such embodiment, the plug or socket may be an AC plug or socket comprising a hot contact, a neutral contact, and a ground contact, and each contact may be electrically connected to a different one of the first, second and third male connector electrical contacts respectively.

In any embodiment, the female connector may further comprise a body having the outer ring shield and the first and second ring insulators may be provided at one end and one of a plug or a socket may be provided at a longitudinally spaced apart second end of the body. In any such embodiment, the plug or socket may be an AC plug or socket comprising a hot contact, a neutral contact, and a ground contact, and each contact is electrically connected to a different one of the first, second and third female connector electrical contacts respectively. Alternately, or in addition, in any such embodiment, the male connector may further comprise a male body having the first, second and third male connector electrical contacts provided at one end and the other of a plug or a socket provided at a longitudinally spaced apart second end of the male body.

In any embodiment, the first female connector electrical contact may comprise a ground.

In any embodiment, the male and female connectors may be secured together by a press fit.

Other aspects and features of the present specification will become apparent, to those ordinarily skilled in the art, upon review of the following description of the specific examples of the specification.

DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

As used herein and in the claims, a first element is said to be "received" in a second element where at least a portion of the first element is received in the second element unless specifically stated otherwise.

Figure 1:
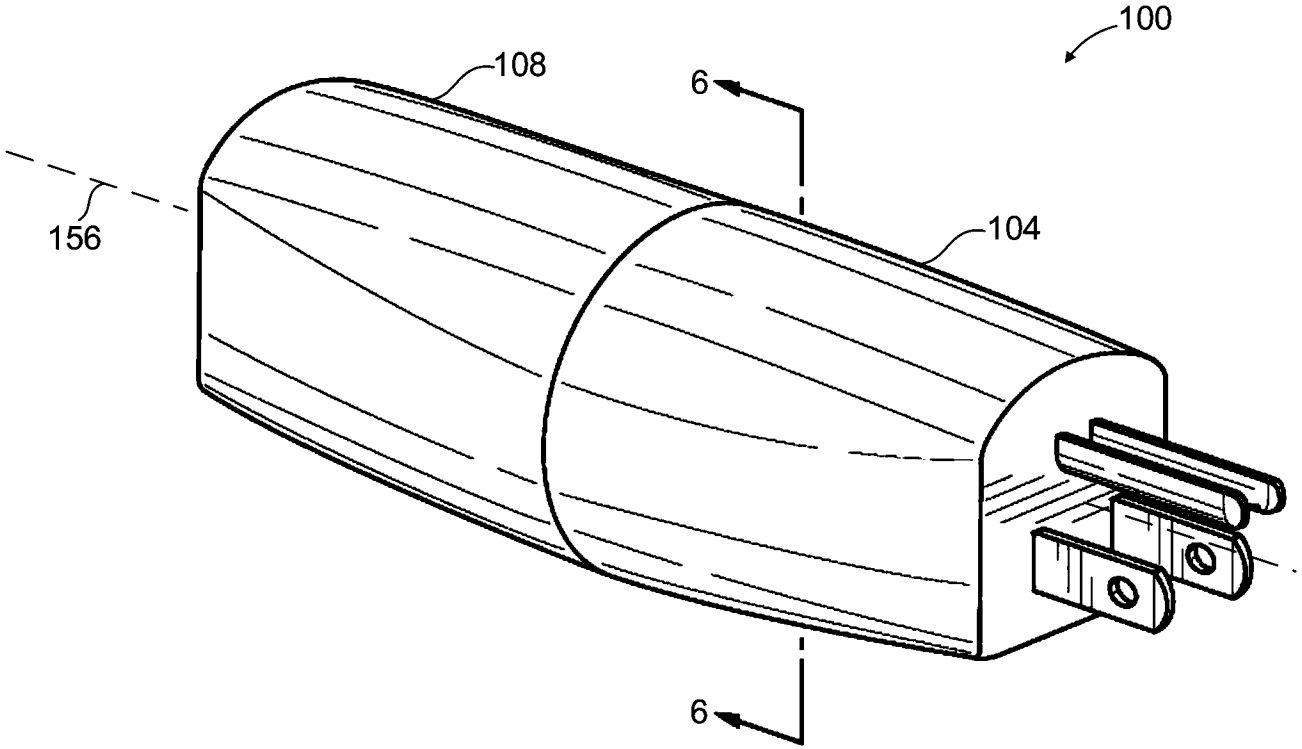
FIG. 1 is a front perspective view of an electrical connector including a male connector and a female connector in accordance with an embodiment.
Figure 2:
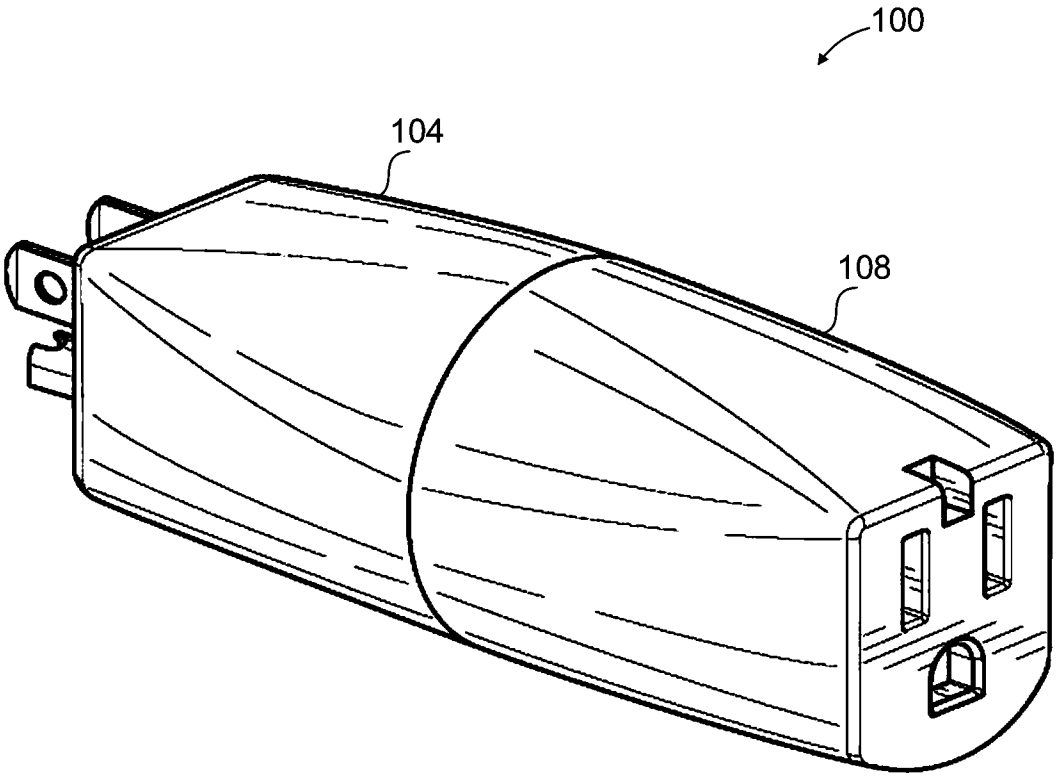
FIG. 2 is a rear perspective view of the electrical connector of FIG. 1.
Figure 3:
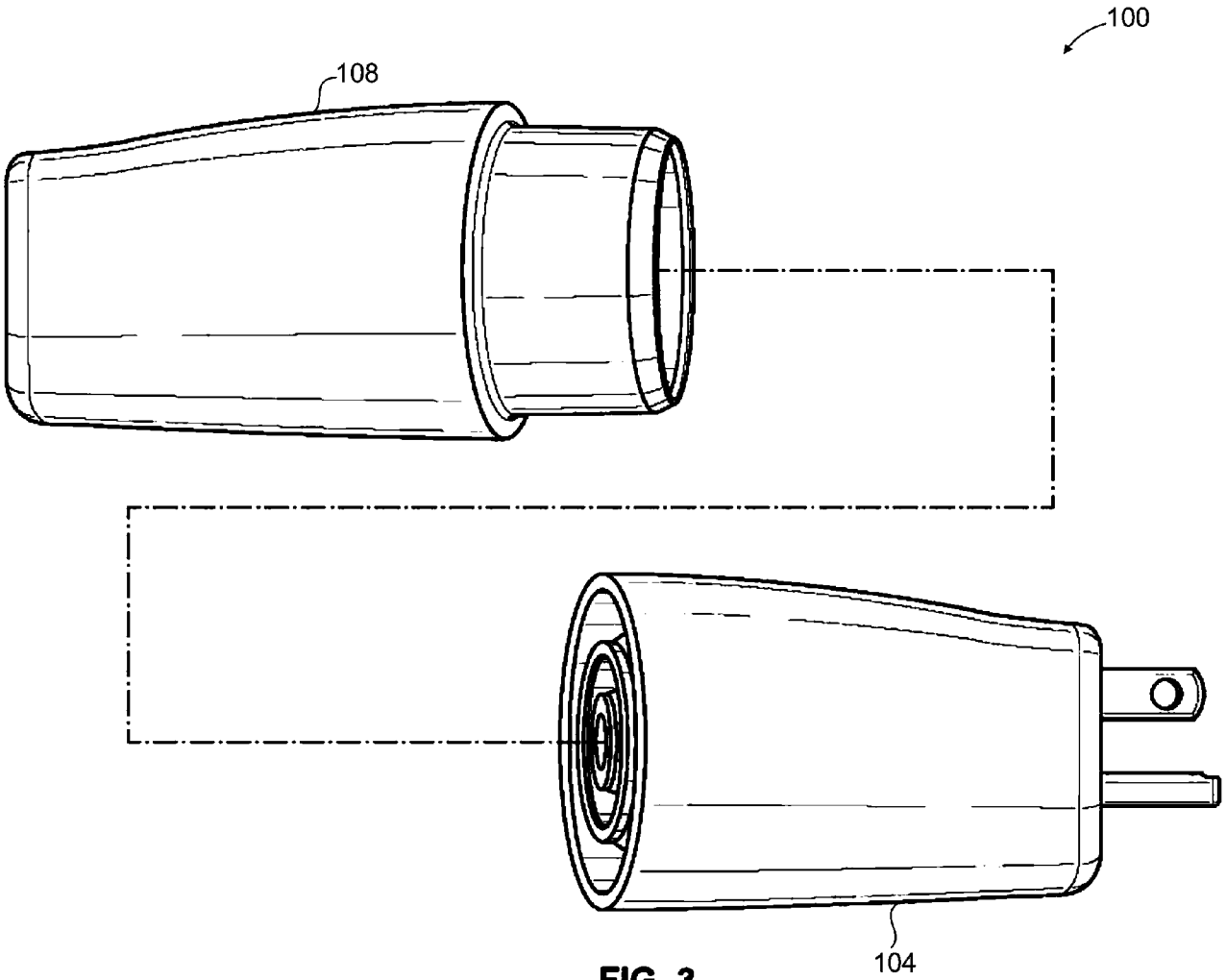
FIG. 3 is a perspective view of the electrical connector of FIG. 1 showing the male connector disconnected from the female connector.

Referring to FIGS. 1-3, an electrical connector 100 is shown in accordance with an embodiment. As shown, electrical connector 100 includes a female connector 104 and a male connector 108 that are removably connectable. When the male connector 108 is inserted into the female connector 104, electrical pathway is completed. Different electrical pathways may correspond to different electrical poles. For example, electrical connector 100 may connect to form electrical pathways for hot, neutral, and ground poles of an AC electrical line.

Figure 4:
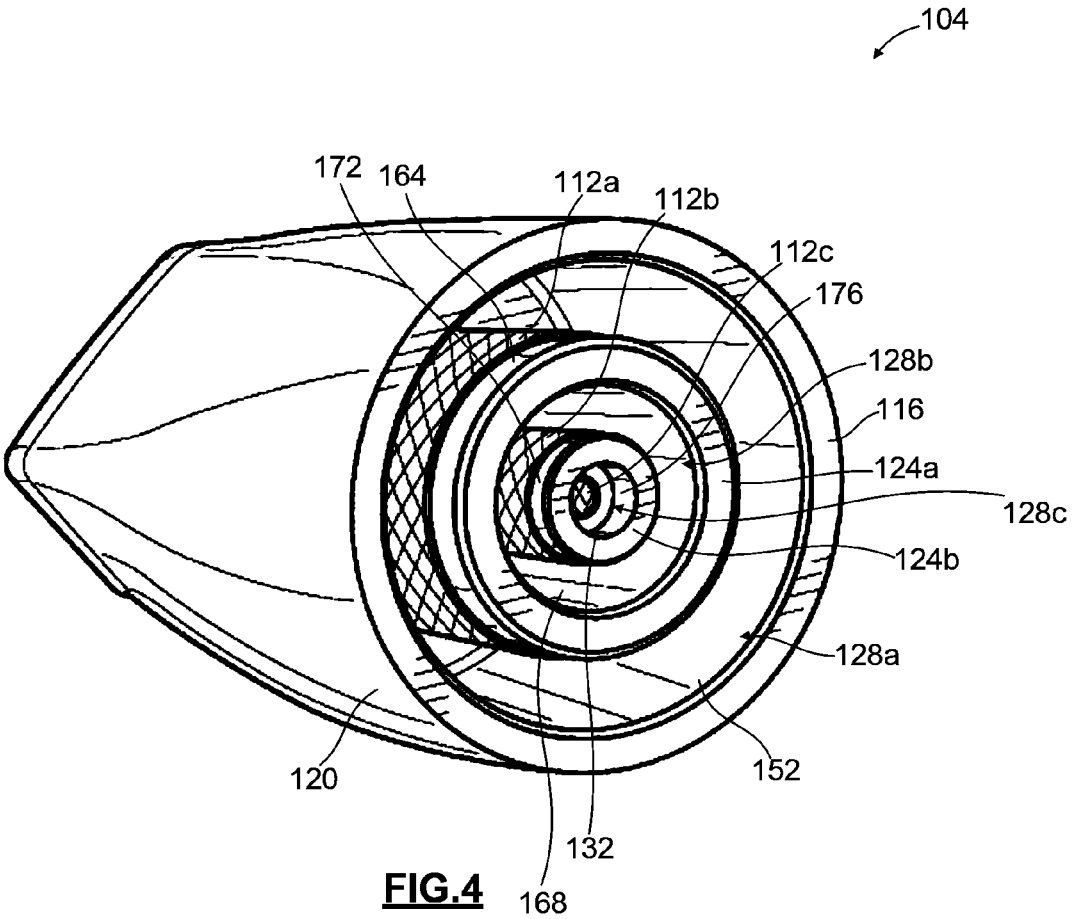
FIG. 4 is a front perspective view of the female connector of FIG. 1.

Referring to FIG. 4, female connector 104 includes a plurality of electrical contacts 112 surrounded by an outer shield 116. Outer shield 116 is made of electrically insulating material. As shown, outer surface 120 of outer shield 116 is free of electrical contacts. By surrounding electrical contacts 112, outer shield 116 mitigates the risk of electrical shock to a user, and provides electrical contacts 112 with protection against weather, dirt, and damage both when connected and disconnected from male connector 108 (FIG. 3).

The electrically insulating material may be any insulating material known in the electrical arts, such as plastic (e.g. acrylic, polyvinyl chloride), rubber and carbon fiber. In some embodiments, the insulating material may be ceramic.

The insulating material may be a selected so as to maintain its shape when pressure is applied thereto. Therefore, if the insulating material is more pliable, such as rubber, then the thickness of the insulating material may be increased. Alternately, if the insulating material is rigid, such as ceramic, then the then the thickness of the insulating material may be reduced.

A material may be referred to as "electrically insulating" if that material has an electrical conductivity of less than 1.0 (S/m) at 20° C. For example, PET plastic has an electrical conductivity of $1.0\times10^{-21}$ S/m at 20° C., whereas most metals which have electrical conductivities exceeding $1\times10^{6}$ S/m at 20° C.

Within female connector 104, electrical contacts 112 may be spaced apart by electrical insulators 124. As exemplified, electrical insulators 124 are configured as annular bands of electrically insulating material. The electrically insulating material may be the same or different to the electrically insulating material from which outer shield 116 is constructed. It will be appreciated that each electrical insulator 124 may be made as a single unitary body or may be made from a plurality of discrete members arranged in an annular band. As exemplified, each electrical insulator 124 may extend axially from the main body further than electrical contacts 112. An advantage of this design is that this helps to mitigate the risk of two electrical contacts 112 being inadvertently short circuited. For example, outer shield 116 and insulators 124 may collectively define a plurality of spaced apart recesses 128, and each electrical contact 112 may be positioned in a different recess 128. This allows male connector 108 (FIG. 3) to be received in the recesses 128 to electrically connect with female connector contacts 112, and to form a secure press fit connection with female connector 104.

As exemplified, female connector 104 includes two insulators 124*a*, and 124*b* and three electrical contacts 112*a*, 112*b*, and 112*c*. First insulator 124*a* is spaced radially inwardly of outer shield 116 to define a first recess 128*a*, and first electrical contact 112*a* is positioned in the first recess 128*a*. Second insulator 124*b* is spaced radially inwardly of first insulator 124*a* to define a second recess 128*b*, and second electrical contact 112*b* is positioned in the second recess 128*b*. Second insulator 124*b* also includes a radial inner cavity 132 defining a third recess 128*c*, and third electrical contact 112*c* is positioned in the third recess 128*c*.

Figure 5:
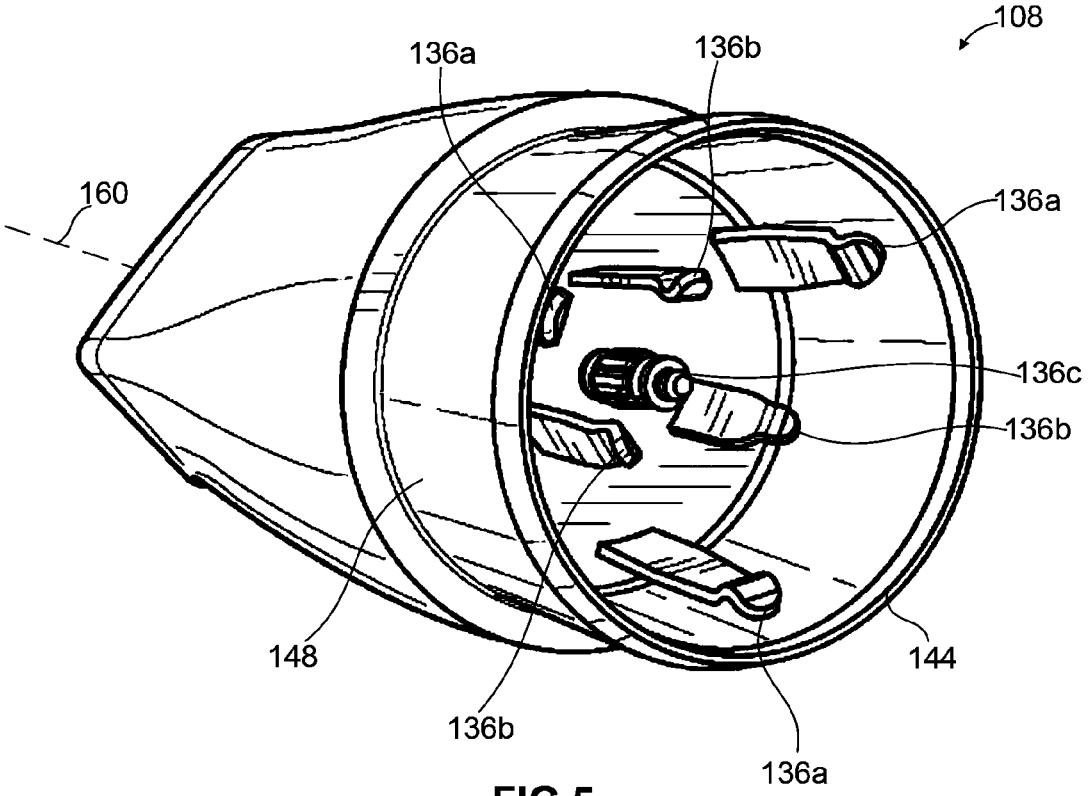
FIG. 5 is a front perspective view of the male connector of FIG. 1.
Figure 6:
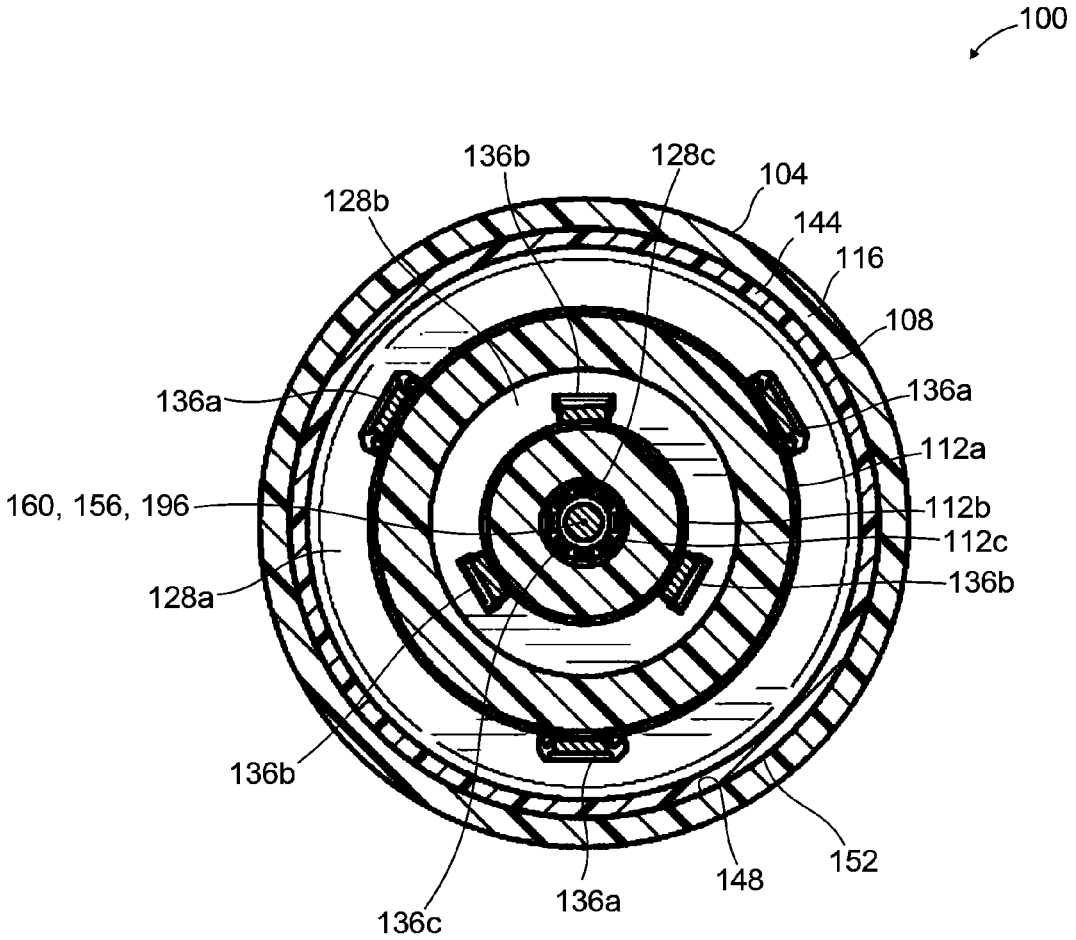
FIG. 6 is a cross-sectional view taken along line 6-6 in FIG. 1.

As exemplified in FIGS. 4 and 5, male connector 108 includes a plurality of electrical contacts 136 for forming an electrical connection with respective female connector contacts 112 (FIG. 4) when male connector 108 is connected with female connector 104 (FIG. 4). As female connector 104 is exemplified with three electrical contacts then male connector 108 may include at least one first male connector contact 136*a*, at least one second male connector contact 136*b*, and at least one third male connector contact 136*c*. As shown in FIG. 6, first, second, and third male connector contacts 136*a*, 136*b*, and 136*c* are sized and positioned to be received in first, second, and third female connector recesses 128*a*, 128*b*, and 128*c* for electrically connecting with first, second, and third female connector contacts 112*a*, 112*b*, and 112*c* respectively when male connector 108 is connected to female connector 104.

Figure 8:
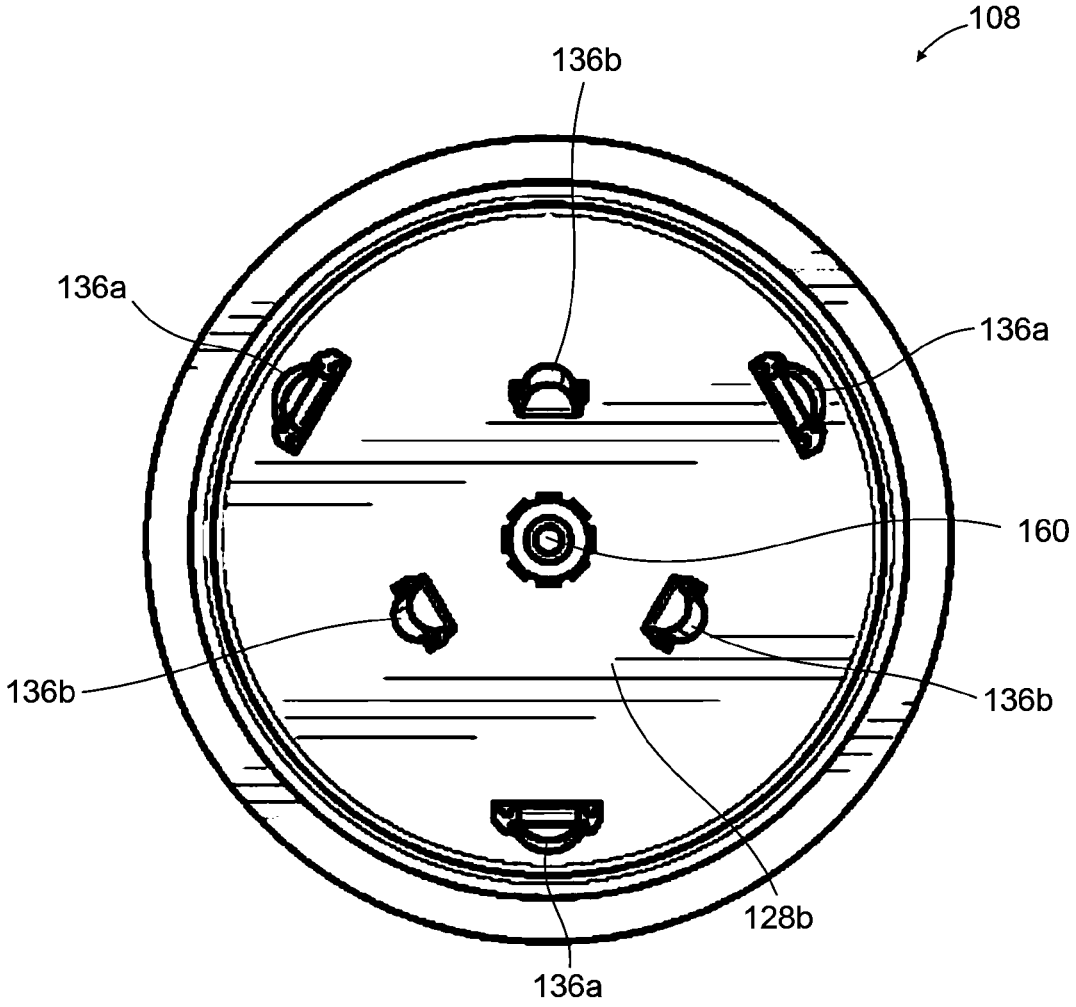
FIG. 8 is a front plan view of the male connector of FIG. 1.
Figure 10:
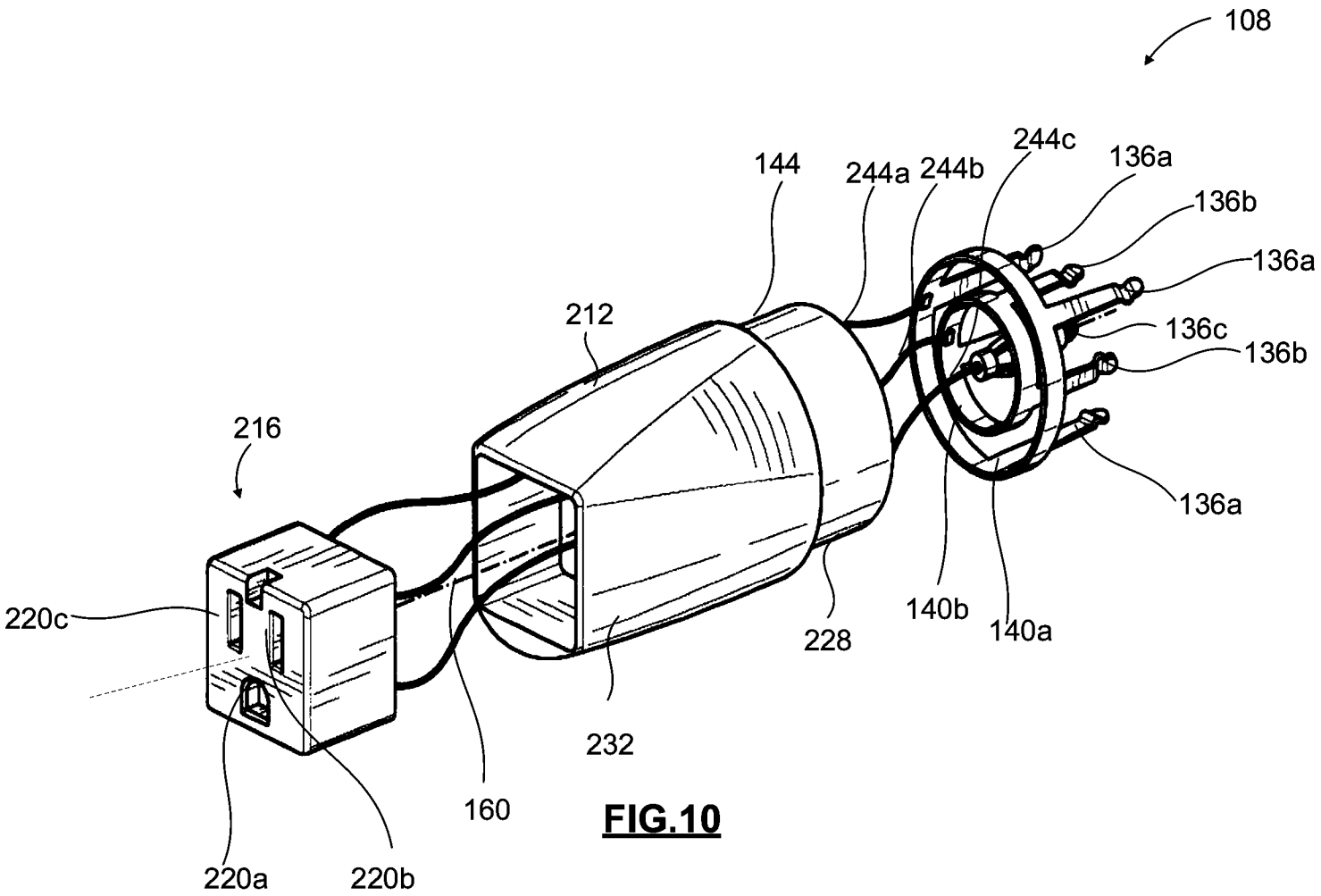
FIG. 10 is an exploded view of the male connector of FIG. 1.

Referring to FIG. 8, male connector 108 each of first, second, and third connector contacts 136 may comprise a single member (which may be configured as an annular band) or as a plurality of discrete members. In the illustrated example, male connector 108 includes three first contacts 136*a*, three second contacts 136*b*, and one third contact 136*c*. As shown in FIG. 6, when female and male connectors 104 and 108 are connected, first female and male connector contacts 112*a* and 136*a* collectively form a first electrical pathway, second female and male connector contacts 112*b* and 136*b* collectively form a second electrical pathway, and third female and male connector contacts 112*c* and 136*b* collectively form a third electrical pathway. Turning to FIG. 10, all of the first male connector contacts 136*a* may be electrically connected by a first contact base 140*a*, and all of the second male connector contacts 136*b* may be electrically connected by a second contact base 140*b*. This allows the plurality of first male connector contacts 136*a* to cooperatively define a first electrical pathway, and allows the plurality of second male connector contacts 136*b* to cooperatively define a second electrical pathway. Similarly, if male connector 108 included a plurality of third contacts 136*c*, then all of the third electrical contacts 136*c* may be electrically connected by a third contact base, so that they cooperatively form a third electrical pathway.

As exemplified in FIGS. 4 and 5, male connector 108 may include an outer shield 144 that surrounds male connector contacts 136. Outer shield 144 is made of electrically insulating material, which may be the same or different as outer shield 116. As shown, outer surface 148 of outer shield 144 is free of electrical contacts. By surrounding electrical contacts 136, outer shield 144 mitigates the risk of electrical shock to a user, and provides electrical contacts 136 with protection against weather, dirt, and damage both when connected and disconnected from female connector 104.

As shown in FIG. 6, male connector outer shield 144 may be sized and positioned for receipt in first female connector recess 128*a* when female and male connectors 104 and 108 are connected. This allows female connector outer shield 116 and male connector outer shield 144 to cooperatively form a double wall shield for electrical connector 100. This provides enhanced safety against electrical shock, and protection against weather, dirt, and damage to the electrical contacts 112 and 136 inside. Furthermore, outer shields 116 and 144 may be sized and shaped to mate with a secure press fit, enhancing the rigidity and robustness of electrical connector 100 when assembled. As shown, male connector outer shield outer surface 148 may frictionally engage female connector outer shield inner surface 152 when female and male connectors 104 and 108 are connected. Alternately, or in addition, it will be appreciated that a locking member may comprise male and female releasable engagement members that may be provided on male and female connectors 104, 108 to releasably secure male and female connectors 104, 108 together.

Figure 7:
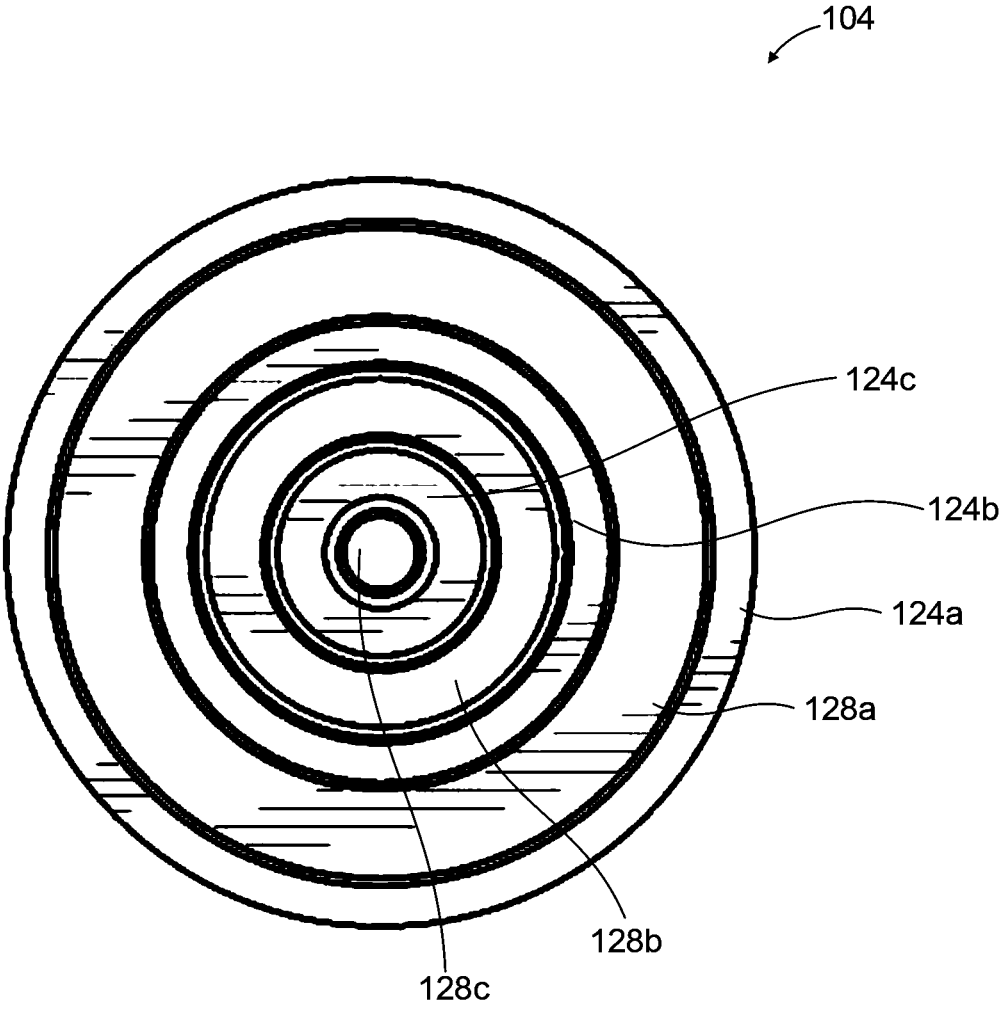
FIG. 7 is a front plan view of the female connector of FIG. 1.

Referring to FIG. 4, female connector insulators 124 may have any shape. Preferably, female connector insulators 124 are shaped to allow female connector 104 to receive male connector 108 regardless of the relative orientation of the connectors 104 and 108 about longitudinal axis 156 of electrical connector 100 (FIG. 1). This makes connecting female and male connectors 104 and 108 simpler and easier for the user. As shown in FIGS. 6-8, female connector insulators 124 may be concentric ring (annular) insulators that define concentric annular recesses 128. As exemplified, male connector contacts 136*a* may be equidistantly arranged from male connector longitudinal axis 160 for insertion into first annular recess 128*a*, and male connector contacts 136*b* may be equidistantly arranged from male connector longitudinal axis 160 for insertion into second annular recess 128*b*. As exemplified, male connector contact 136*c* may be positioned along male connector longitudinal axis 160 for insertion into central recess 128*c*. It will be appreciated that male connector contacts 136*a*, 136*b* may not be equidistantly spaced apart.

Contacts 112 and 136 may be any one or more types of electrical contacts. For example, contacts 112 and 136 may be one or more of sleeve-type contacts, prong-type contacts, and pin-type contacts. Referring to FIGS. 4 and 5, the illustrated example shows female connector contacts 112 as sleeve-type contacts, male connector contacts 136*a* and 136*b* as prong-type contacts, and male connector contact 136*c* as a pin-type contact. As exemplified, female connector contact 112*a* may at least substantially line a surface of first recess 128*a*, female connector contact 112*b* may at least substantially line a surface of second recess 128*b*, and female connector contact 112*c* may at least substantially line a surface of third recess 128*c*. This allows the prong and pin type male connector contacts 136 to be received in recesses 128 to make physical contact (and thereby electrical connection) with the female connector contacts 112 that line a surface thereof.

As exemplified, first recess 128*a* may be bounded by female connector outer shield inner surface 152 and first ring insulator outer surface 164, second recess 128*b* may be bounded by first ring insulator inner surface 168 and second ring insulator outer surface 172, and third recess 128*c* may be bounded by second ring insulator inner surface 176. As exemplified, first female connector contact 112*a* may line surface 164, second female connector contact 112*b* may line surface 172, and second female connector contact 112*c* may line surface 176. Alternatively, first female connector contact 112*a* may line surface 152 or both of surfaces 152 and 164. Alternatively, or in addition, second female connector contact 112*b* may line surface 168 or both of surfaces 168 and 172.

Electrical connector 100 provides a disconnectable connection for a continuous electrical pathway. For example, electrical connector 100 may include or accommodate a connection to one or more of electrical cables, plugs, and sockets. When female and male connectors 104 and 108 of electrical connector 100 are connected, electricity may flow between those electrical cables, plugs, and/or sockets if the circuit is closed.

It will be appreciated that male and female connectors may be used in place of existing male and female connectors. Accordingly female connector 104 may be used in a socket and male connector 108 may be used as the end of an electrical cord. Alternately, as exemplified in FIGS. 9 and 10, female and male connectors 104, 108 may be connectable to existing electrical cords or the like. Therefore, for example, electrical connector 100 may provide a disconnectable junction between two typical power cords. Accordingly, female connector 104 may include one of a plug or socket (e.g. an AC type plug or socket), and the male connector 108 may include the other of the plug or socket. This allows electrical connector 100 to bridge a connection between existing male and female connectors.

Figure 9:
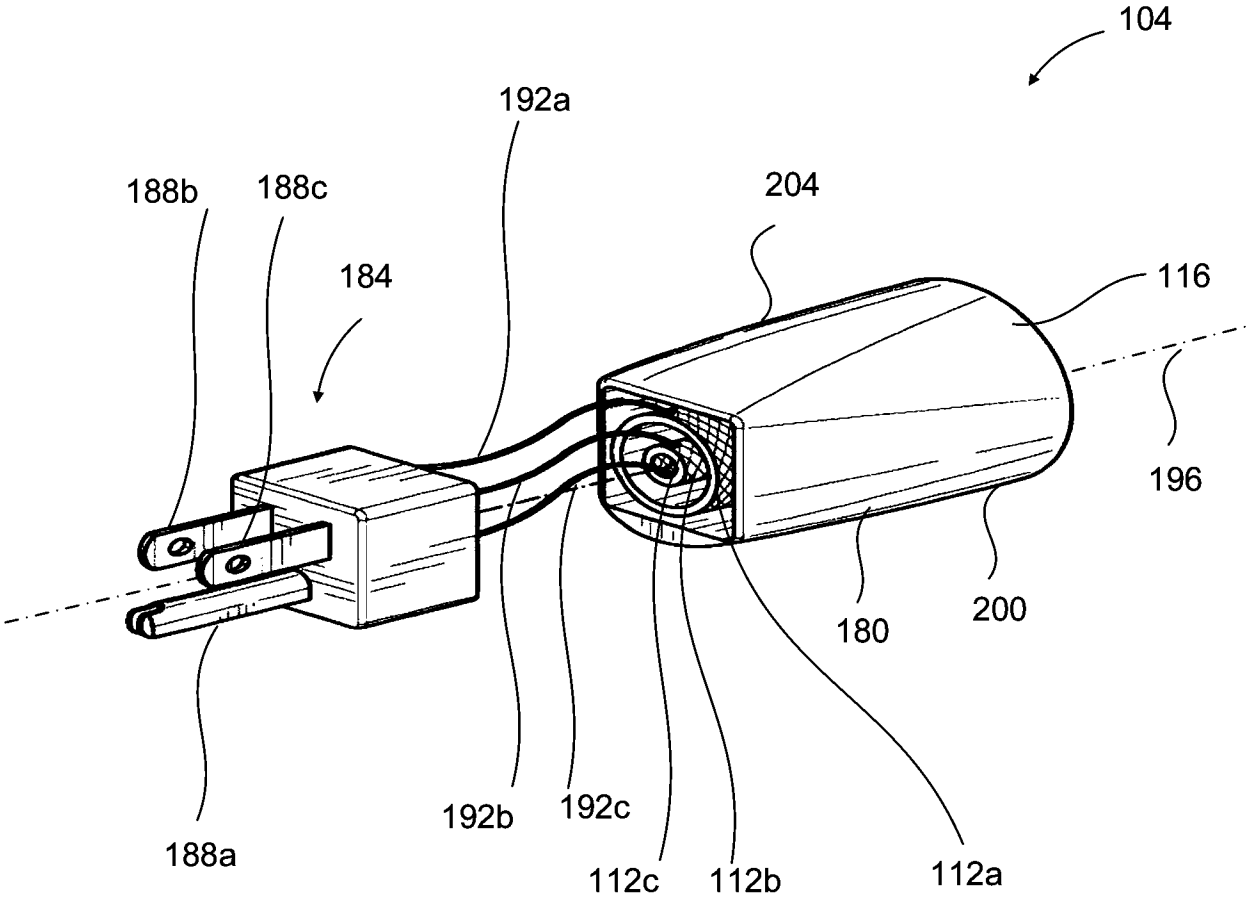
FIG. 9 is an exploded view of the female connector of FIG. 1.

As exemplified in FIG. 9, female connector 104 includes a female main connector body 180, which includes female connector outer shield 116, and which houses female connector contacts 112 in addition to an electrical plug 184. Alternatively, female connector body 180 may house an electrical socket 216 (see FIG. 10) instead of electrical plug 184. As shown, the electrical plug 184 may be an AC type electrical plug, such as any known international variety of AC type electrical plug. For example, electrical plug 184 may be rated for use with power over 100V, such as 120V or 220V power. In the illustrated example, electrical plug 184 includes three electrical plug contacts 188. Electrical plug contacts 188 may include a ground contact 188*a*, a hot contact 188*b*, and a neutral contact 188*c*. Each female connector contact 112 may be electrically connected to a different one of electrical plug contacts 188. The electrical connection may be formed by direct contact between the female connector, or by electrical wires 192 as shown. In the illustrated example, female connector contact 112*a* is electrically connected to ground contact 188*a* by electrical wire 192*a*, female connector contact 112*b* is electrically connected to hot contact 188*b* by electrical wire 192*b*, and female connector contact 112*c* is electrically connected to neutral contact 188*c* by electrical wire 192*c*. It will be appreciated that in alternative embodiment, there can be different pairings of the electrical socket contacts 188 and the female connector contacts 112. It will also be appreciated that the plug or socket provided in connector body 180 may be configured to receive any plug or socket known in the electrical arts.

Female connector contacts 112 and electrical plug 184 are provided in different portions of female connector body 180. This can allow female connector contacts 112 and electrical plug 184 to face different directions, as shown. In turn, this allows a male connector 108 and another electrical appliance (e.g. power cord) to simultaneously connect with female connector 104 in different directions without mutually interfering. Female connector 104 has a longitudinal axis 196. In the illustrated example, connector contacts 112 and electrical plug 184 are longitudinally spaced apart. Connector contacts 112 are provided at a first longitudinal end 200 of female connector body 180, and electrical plug 184 is provided at a second longitudinal end 204 of female connector body 180. Female connector contacts 112 and electrical plug 184 may be oriented in parallel (e.g. with longitudinal axis 196) as shown, or electrical plug 184 may be oriented non-parallel with longitudinal axis 196 and female connector contacts 112. In an alternate embodiment, it will be appreciated that the plug 184 or socket 216 may be provided elsewhere on body 180, such as a longitudinally extending sidewall thereof.

As exemplified in FIG. 10, male connector 108 includes a male main connector body 212, which includes male connector outer shield 144, and which houses male connector contacts 136 in addition to an electrical socket 216. Alternatively male connector body 212 may house an electrical plug 184 instead of electrical socket 216. As shown, the electrical socket 216 may be an AC type electrical socket, such any known international variety of AC type electrical socket. For example, electrical socket 216 may be rated for use with power over 100V, such as 120V or 220V power. In the illustrated example, electrical socket 216 includes three electrical socket contacts 220. Electrical socket contacts 220 may include a ground contact 220*a*, a hot contact 220*b*, and a neutral contact 220*c*. Each male connector contact 136 may be electrically connected to a different one of electrical socket contacts 220. The electrical connection may be formed by direct contact between the male connector, or by electrical wires 224 as shown. In the illustrated example, male connector contact 136*a* is electrically connected to ground contact 220*a* by electrical wire 224*a*, male connector contact 136*b* is electrically connected to hot contact 220*b* by electrical wire 224*b*, and male connector contact 136*c* is electrically connected to neutral contact 220*c* by electrical wire 224*c*. It will be appreciated that in alternative embodiment, there can be different pairings of the electrical socket contacts 220 and the male connector contacts 136. It will also be appreciated that the plug or socket provided in connector body 212 may be configured to receive any plug or socket known in the electrical arts.

Male connector contacts 136 and electrical socket 216 are provided in different portions of male connector body 212. This can allow male connector contacts 136 and electrical socket 216 to face different directions, as shown. In turn, this allows a female connector 104 and another electrical appliance (e.g. power cord) to connect with male connector 108 in different directions without interference. In the illustrated example, male connector contacts 136 and electrical socket 216 are longitudinally spaced apart. Connector contacts 136 are provided at a first longitudinal end 228 of male connector body 212, and electrical socket 216 is provided at a second longitudinal end 232 of male connector body 212. Male connector contacts 136 and electrical socket 216 may be oriented in parallel (e.g. with longitudinal axis 160) as shown, or electrical socket 216 may be oriented non-parallel with longitudinal axis 160 and male connector contacts 136. In an alternate embodiment, it will be appreciated that the plug 184 or socket 216 may be provided elsewhere on body 212, such as a longitudinally extending sidewall thereof.

Figure 11:
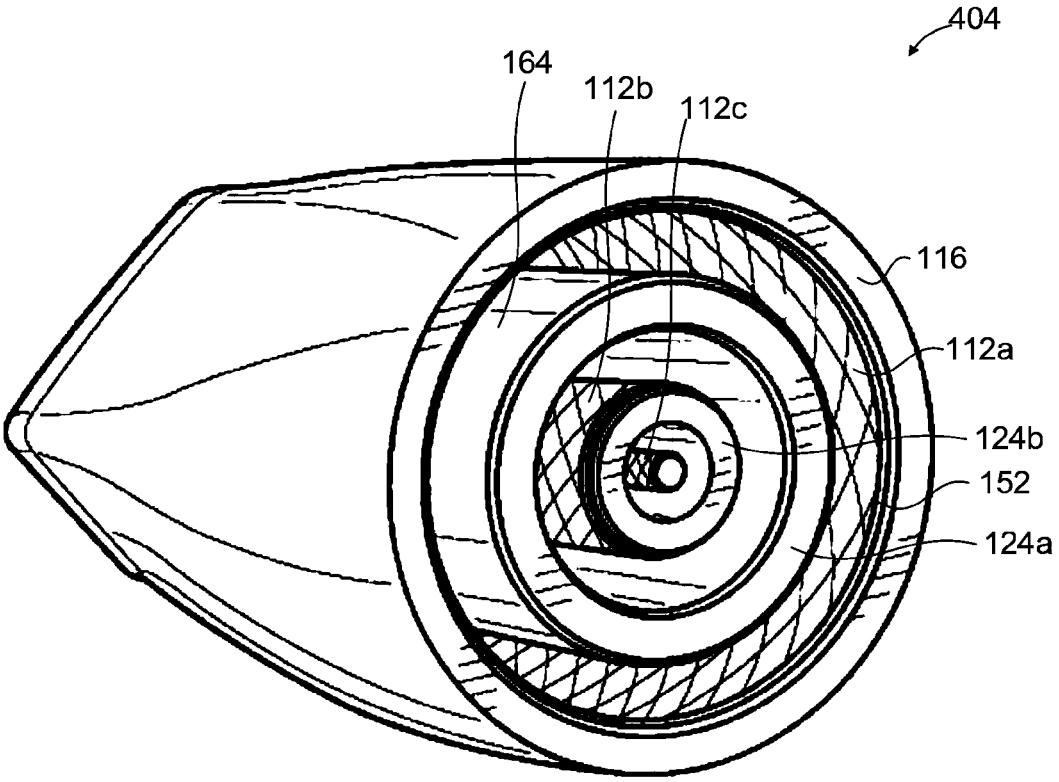
FIG. 11 is a front perspective view a female connector in accordance with another embodiment.
Figure 12:
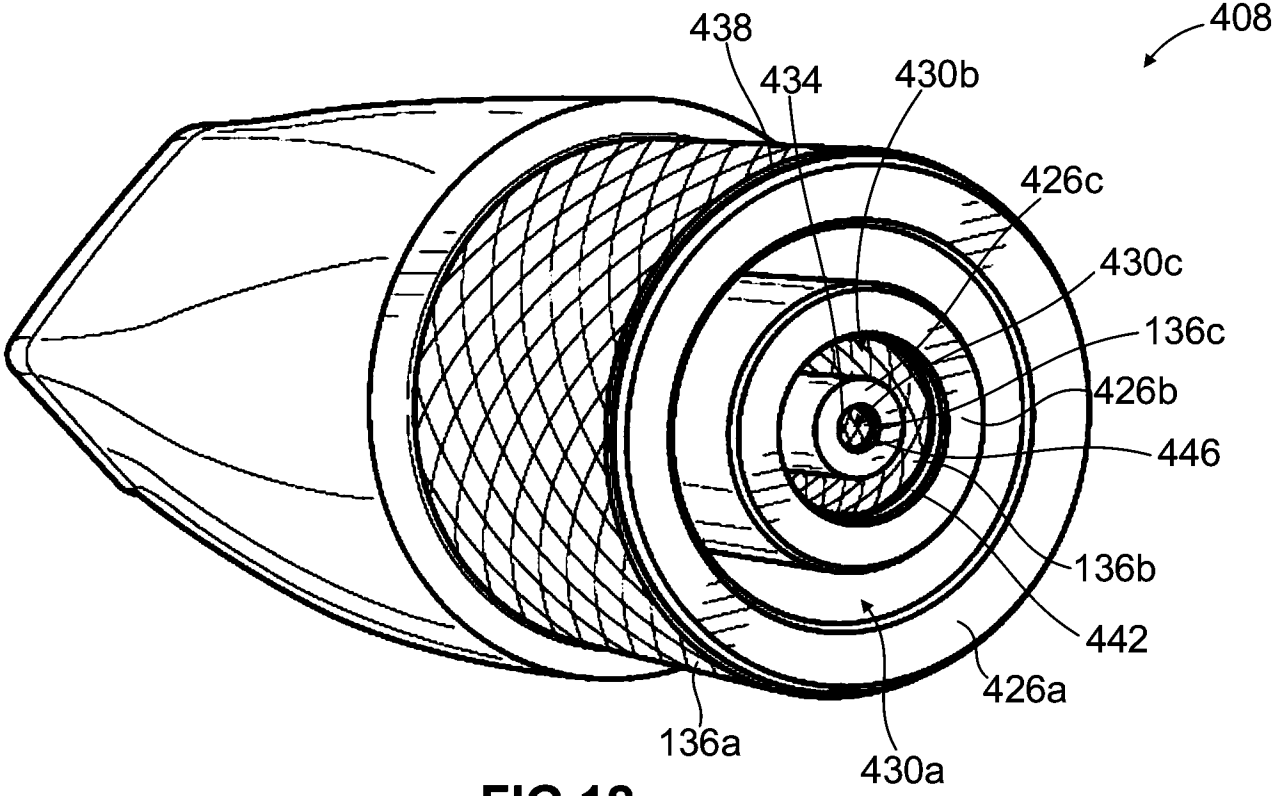
FIG. 12 is a front perspective view of a male connector in accordance with another embodiment; and, FIG. 13 is a side elevation view of an electrical connector including the male and female connectors of FIGS. 11 and 12, partially cut-away to show the internal connection therebetween.
Figure 13:
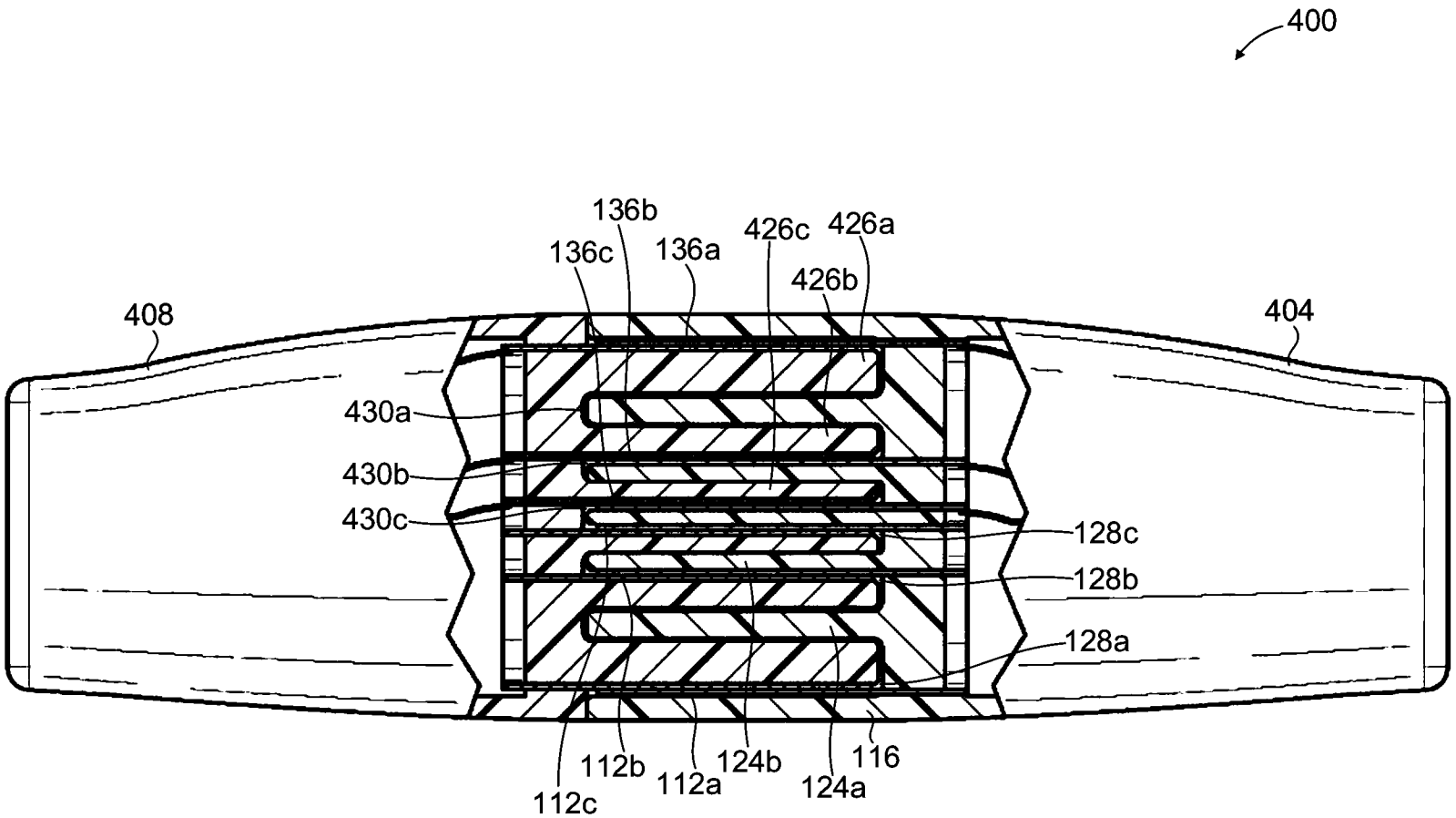

Reference is now made to FIGS. 11-13, which show an electrical connector 400 including a female connector 404 and a male connector 408, in accordance with another embodiment. Electrical connector 400 is similar to electrical connector 100 in many respects, except for example the configuration of the electrical contacts of the female and male connectors 404 and 408.

As exemplified in FIG. 11, female connector 404 may comprise a plurality of female connector contacts 112 spaced apart by a plurality of female connector insulators 124 and surrounded by a female connector outer shield 116. In contrast with female connector 104 (FIG. 4), female connector contact 112*a* lines female connector outer shield inner surface 152 instead of first female connector insulator outer surface 164, and female connector contact 112*c* is a pin-type contact instead of a sleeve-type contact.

As exemplified in FIG. 12, male connector 408 may comprise male connector contacts 136 spaced apart by a plurality of male connector insulators 426. Similar to female connector insulators 124, male insulators 426 are made of electrically insulating material, may have any shape and configuration suitable for mating with female connector 404, and may be spaced apart from each other to define male connector recesses 430. Referring to FIGS. 11-13, when female and male connectors 404 and 408 are connected, male connector insulators 426 are received in female connector recesses 128, and female connector insulators 124 are received in male connector recesses 430, whereby male connector contacts 136 physically contact female connector contacts 112 forming electrical connection therebetween. The mutual reception of male and female connector insulators 426 and 124 into female and male connector recesses 128 and 430 can provide greater contact surface area between connectors 404 and 408 for a more secure and robust connection.

As exemplified in FIG. 12, male connector 408 includes three insulators 426 and three electrical contacts 136. Second insulator 426*b* is spaced inwardly of first insulator 426*a* to define a first recess 430*a*, third insulator 426*c* is spaced inwardly of second insulator 426*b* to define a second recess 430*b*, and second insulator 426*b* includes an inner cavity 434 defining a third recess 430*c*. Referring to FIGS. 11-12, Male connector insulators 426*a*, 426*b*, and 426*c* are sized and shape for receipt in female connector recesses 128*a*, 128*b*, and 128*c* respectively. Similarly, male connector recesses and 430*a* and 430*b* are sized and shaped to receive female connector insulators 124*a* and 124*b* respectively. In the illustrated example, male connector insulators 426 are concentric ring shaped insulators which define annular male connector recesses 430 therebetween.

Referring to FIGS. 11-13, male connector contacts 136 are sized and positioned to make physical contact with respective female connector contacts 112 when female and male connectors 404 and 408 are connected. As shown, male connector contact 136*a* is positioned outside of male connector insulator 426*a*, male connector contact 136*b* is positioned within second male connector recess 430*b*, and male connector contact 136*c* is positioned within third male connector recess 430*c*. Male connector contacts 136 can have any configuration suitable for forming an electrical connection with respective female connector contacts 112. In the illustrated example, male connector contact 136*a* is a sleeve-type contact that lines first male connector insulator outer surface 438, second male connector contact 136*b* is a sleeve-type contact that lines second male connector insulator inner surface 442, and third male connector contact 136*c* is a sleeve-type contact that line third male connector insulator inner surface 446. In this example, the mating female and male connector contacts 112*a*/136*a*, and 112*b*/136*b* are both sleeve-type contacts, which provide large contact surface areas for robust electrical connections with lower electrical resistance (and therefore less heat generation).

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. An electrical connector comprising:

a) a female connector comprising:

i) an outer ring shield, wherein the outer ring shield comprises an outer ring shield outer surface and an outer ring shield inner surface that are both free of electrical contacts;

ii) a first ring insulator spaced inwardly of the outer ring shield to define a first recess between the outer ring shield and the first ring insulator with a first female connector electrical contact provided in the first recess;

iii) a second ring insulator spaced inwardly of the first ring insulator to define a second recess between the first and second ring insulators with a second female connector electrical contact provided in the second recess, and, b) a male connector removably connectable with the female connector, the male connector comprising at least one first male connector electrical contact and at least one second male connector electrical contact, wherein when the male and female connectors are electrically connected together, the first male connector electrical contact is received in the first recess and the second male connector electrical contact is received in the second recess, and wherein the first ring insulator has a first ring insulator outer surface, and the first female connector electrical contact is a sleeve contact that at least substantially lines the first ring insulator outer surface.

2. The electrical connector of claim 1, wherein the second ring insulator has an inner cavity defining a third recess with a third female connector electrical contact provided in the third recess and the male connector comprises at least one third male connector electrical contact, wherein when the male and female connectors are electrically connected together, the third male connector electrical contact is received in the third recess.

3. The electrical connector of claim 2, wherein the second ring insulator has a second ring insulator inner surface, and the third female connector electrical contact is a sleeve contact that at least substantially lines the second ring insulator inner surface.

4. The electrical connector of claim 2, wherein the third male connector electrical contact is a pin contact.

5. The electrical connector of claim 2, wherein the third female connector electrical contact is a pin contact.

6. The electrical connector of claim 2, wherein the third male connector electrical contact is a sleeve contact.

7. The electrical connector of claim 2, wherein the male connector further comprises a body having the first, second and third male connector electrical contacts provided at one end and one of a plug or a socket provided at a longitudinally spaced apart second end of the body.

8. The electrical connector of claim 7, wherein the plug or socket is an AC plug or socket comprising a hot contact, a neutral contact, and a ground contact, and each contact is electrically connected to a different one of the first, second and third male connector electrical contacts respectively.

9. The electrical connector of claim 2, wherein the female connector further comprises a body having the outer ring shield and the first and second ring insulators provided at one end and one of a plug or a socket provided at a longitudinally spaced apart second end of the body.

10. The electrical connector of claim 9, wherein the plug or socket is an AC plug or socket comprising a hot contact, a neutral contact, and a ground contact, and each contact is electrically connected to a different one of the first, second and third female connector electrical contacts respectively.

11. The electrical connector of claim 9, wherein the male connector further comprises a male body having the first, second and third male connector electrical contacts provided at one end and the other of a plug or a socket provided at a longitudinally spaced apart second end of the male body.

12. The electrical connector of claim 2, wherein the first female connector electrical contact comprises a ground.

13. The electrical connector of claim 1, wherein the first and second ring recesses are concentric annular recesses.

14. The electrical connector of claim 1, wherein the first ring insulator has a first ring insulator inner surface, the second ring insulator has a second ring insulator outer surface, and the second female connector electrical contact is a sleeve contact that at least substantially lines at least one of the first ring insulator inner surface and the first ring insulator outer surface.

15. The electrical connector of claim 1, wherein the male and female connectors are secured together by a press fit.

16. The electrical connector of claim 1, wherein the male connector comprises a male connector outer ring shield that surrounds the first and second male connector electrical contacts, wherein the male connector outer ring shield has an outer surface that is free of electrical contacts.

17. An electrical connector comprising:

a) a female connector comprising:

i) an outer ring shield, wherein the outer ring shield comprises an outer ring shield outer surface and an outer ring shield inner surface that are both free of electrical contacts;

ii) a first ring insulator spaced inwardly of the outer ring shield to define a first recess between the outer ring shield and the first ring insulator with a first female connector electrical contact provided in the first recess;

iii) a second ring insulator spaced inwardly of the first ring insulator to define a second recess between the first and second ring insulators with a second female connector electrical contact provided in the second recess, and, b) a male connector removably connectable with the female connector, the male connector comprising at least one first male connector electrical contact and at least one second male connector electrical contact, wherein when the male and female connectors are electrically connected together, the first male connector electrical contact is received in the first recess and the second male connector electrical contact is received in the second recess, wherein the male connector comprises a male connector outer ring shield that surrounds the first and second male connector electrical contacts, wherein the male connector outer ring shield has an outer surface that is free of electrical contacts, and wherein the male connector outer ring shield is received in the first recess when the male and female connectors are electrically connected together.

* * * * *